US012180737B2

(12) United States Patent
Varnum et al.

(10) Patent No.: US 12,180,737 B2
(45) Date of Patent: Dec. 31, 2024

(54) POST DRIVER AND REMOVER

(71) Applicant: AOB Products Company, Columbia, MO (US)

(72) Inventors: Ryan Varnum, Columbia, MO (US); Timothy S. Kinney, Warrenton, MO (US); Kyle Smith, Columbia, MO (US); Matthew Kinamore, Columbia, MO (US); James Tayon, Moberly, MO (US); Seth Wheeler, Columbia, MO (US); Aaron Wood, Columbia, MO (US); Jason Nickerson, Columbia, MO (US); Curtis Smith, Columbia, MO (US); Bryan Mach, Columbia, MO (US); Eric Smith, Columbia, MO (US)

(73) Assignee: AOB Products Company, Columbia, MO (US)

( * ) Notice: Subject to any disclaimer, the term of this patent is extended or adjusted under 35 U.S.C. 154(b) by 623 days.

(21) Appl. No.: 17/444,949

(22) Filed: Aug. 12, 2021

(65) Prior Publication Data

US 2022/0049522 A1 Feb. 17, 2022

Related U.S. Application Data

(60) Provisional application No. 63/064,789, filed on Aug. 12, 2020.

(51) Int. Cl.
*E04H 17/00* (2006.01)
*E04H 17/26* (2006.01)

(52) U.S. Cl.
CPC ..... *E04H 17/265* (2013.01); *E04H 17/263* (2013.01)

(58) Field of Classification Search
CPC ..... E04H 17/265; E04H 17/20
See application file for complete search history.

(56) References Cited

U.S. PATENT DOCUMENTS

| | | | |
|---|---|---|---|
| 1,916,463 | A | 7/1933 | Carrel |
| 2,098,146 | A | 11/1937 | Hunt |
| 2,690,055 | A | 9/1954 | Lundgren et al. |
| 3,115,199 | A | 12/1963 | Linabery |
| 3,712,389 | A | 1/1973 | Smoak |
| 3,792,739 | A | 2/1974 | Deike |
| 4,589,500 | A | 5/1986 | Moraly |
| 4,971,479 | A | 11/1990 | Byers, Sr. et al. |
| 5,020,605 | A | 6/1991 | Leishman |
| 5,029,651 | A | 7/1991 | Ubbink |
| 5,262,113 | A | 11/1993 | Carmien |

(Continued)

*Primary Examiner* — Lee D Wilson
(74) *Attorney, Agent, or Firm* — Stinson LLP

(57) ABSTRACT

A post driver and remover for the installation and removal of posts includes a post receiver having a post receiver body having a driving end and an opposite driven end. The post receiver body defines a post receiving space having an open end adjacent the driven end and a closed end adjacent the driving end. The post receiving space is sized and shaped to receive an upper end portion of one of the posts. The post receiver body also has a first extractor and a second extractor. The first extractor receives a first post of a first cross-sectional size or shape, and the second extractor has a different size or shape from the first extractor to receive a second post of a second cross-sectional size or shape.

51 Claims, 6 Drawing Sheets

(56) References Cited

U.S. PATENT DOCUMENTS

| | | | | |
|---|---|---|---|---|
| 5,397,130 | A | 3/1995 | Brown | |
| 5,462,126 | A | 10/1995 | Wallace | |
| 5,538,090 | A | 7/1996 | Siler | |
| 5,588,343 | A | 12/1996 | Rust | |
| 5,806,453 | A | 9/1998 | Cook | |
| 6,364,031 | B1 | 4/2002 | Amicangelo | |
| 6,370,986 | B1 | 4/2002 | Scott | |
| 6,571,885 | B2 | 6/2003 | Lee, Jr. et al. | |
| 6,595,087 | B2 | 7/2003 | Whalen et al. | |
| 6,619,408 | B1 | 9/2003 | Lai | |
| 6,763,747 | B1 | 7/2004 | Gierer et al. | |
| 6,772,565 | B1 | 8/2004 | Schiltz et al. | |
| 7,117,955 | B2 | 10/2006 | Rivers et al. | |
| D587,548 | S | 3/2009 | O'Toole | |
| 7,555,870 | B1 | 7/2009 | Schiltz et al. | |
| 7,832,497 | B2 | 11/2010 | Wilson | |
| 7,837,177 | B2 | 11/2010 | McNeill | |
| 7,980,323 | B2 | 7/2011 | Wilson | |
| 8,047,099 | B2 | 11/2011 | St. John et al. | |
| D658,953 | S | 5/2012 | Wilson | |
| 8,230,944 | B2 * | 7/2012 | Thiem | E04H 17/268 173/90 |
| 8,276,683 | B1 | 10/2012 | Roy | |
| D675,494 | S | 2/2013 | Beem | |
| 8,701,791 | B2 * | 4/2014 | Page | E04H 17/265 173/90 |
| 8,955,612 | B2 | 2/2015 | O'Toole | |
| 9,051,705 | B1 | 6/2015 | Rose | |
| 9,181,726 | B2 | 11/2015 | McNeill | |
| 9,206,578 | B1 | 12/2015 | Rose | |
| D778,136 | S | 2/2017 | Chen | |
| D786,031 | S | 5/2017 | Whitten | |
| D829,517 | S | 10/2018 | Coleman | |
| D850,877 | S | 6/2019 | Zhang | |
| 10,364,590 | B1 | 7/2019 | Johnston | |
| D877,580 | S * | 3/2020 | Dishman | D8/14 |
| 2002/0139548 | A1 | 10/2002 | Connelly, Jr. | |
| 2007/0181320 | A1 | 8/2007 | Mason | |
| 2011/0049451 | A1 * | 3/2011 | Thiem | E04H 17/268 256/1 |
| 2011/0108298 | A1 | 5/2011 | Zhou | |
| 2012/0145425 | A1 * | 6/2012 | Page | E04H 17/265 254/133 R |
| 2018/0202188 | A1 | 7/2018 | Dishman | |
| 2019/0119948 | A1 | 4/2019 | Dishman | |
| 2020/0256079 | A1 | 8/2020 | McIntosh | |
| 2021/0047858 | A1 * | 2/2021 | Castell | E02D 7/04 |
| 2022/0049522 | A1 * | 2/2022 | Varnum | E04H 17/265 |
| 2023/0146723 | A1 * | 5/2023 | Hochstetler | E01F 9/70 173/90 |

* cited by examiner

POST DRIVER AND REMOVER

CROSS-REFERENCE TO RELATED APPLICATION

This application claims priority to U.S. Provisional Application No. 63/064,789, filed Aug. 12, 2020, the entirety of which is hereby incorporated by reference.

FIELD

The present disclosure generally relates post drivers and removers for the installation and removal of posts and the like.

BACKGROUND

Post drivers are used to install posts by ramming or driving the posts into the ground. Generally, a user repeatedly hits the post into the ground with the post driver by lifting the post driver and then hitting the post with the post driver.

SUMMARY

In one aspect, a post driver and remover for the installation and removal of posts comprises a post receiver having a post receiver body having a driving end and an opposite driven end. The post receiver body defines a post receiving space having an open end adjacent the driven end and a closed end adjacent the driving end. The post receiving space is sized and shaped to receive an upper end portion of one of the posts. The post receiver body has a first extractor and a second extractor. The first extractor is configured to receive a first post of a first cross-sectional size or shape. The second extractor is configured to have a different size or shape from the first extractor to receive a second post of a second cross-sectional size or shape.

In another aspect, a post driver for installing a post comprises a post receiver having a post receiver body having a driving end and an opposite driven end. The post receiver body defines a post receiving space having an open end adjacent the driven end and a closed end adjacent the driving end. The post receiving space is sized and shaped to receive an upper end portion of the post. A handle includes a handle body connected to the post receiver body and a grip mounted on the handle body. The grip is disposed in a grip cavity of the handle body. The grip is arranged to be engaged by the user when the user operates the post driver to install the post.

Other objects and features of the present disclosure will be in part apparent and in part pointed out herein.

BRIEF DESCRIPTION OF THE DRAWINGS

Corresponding reference characters indicate corresponding parts throughout the drawings.

DETAILED DESCRIPTION

Figure 1:
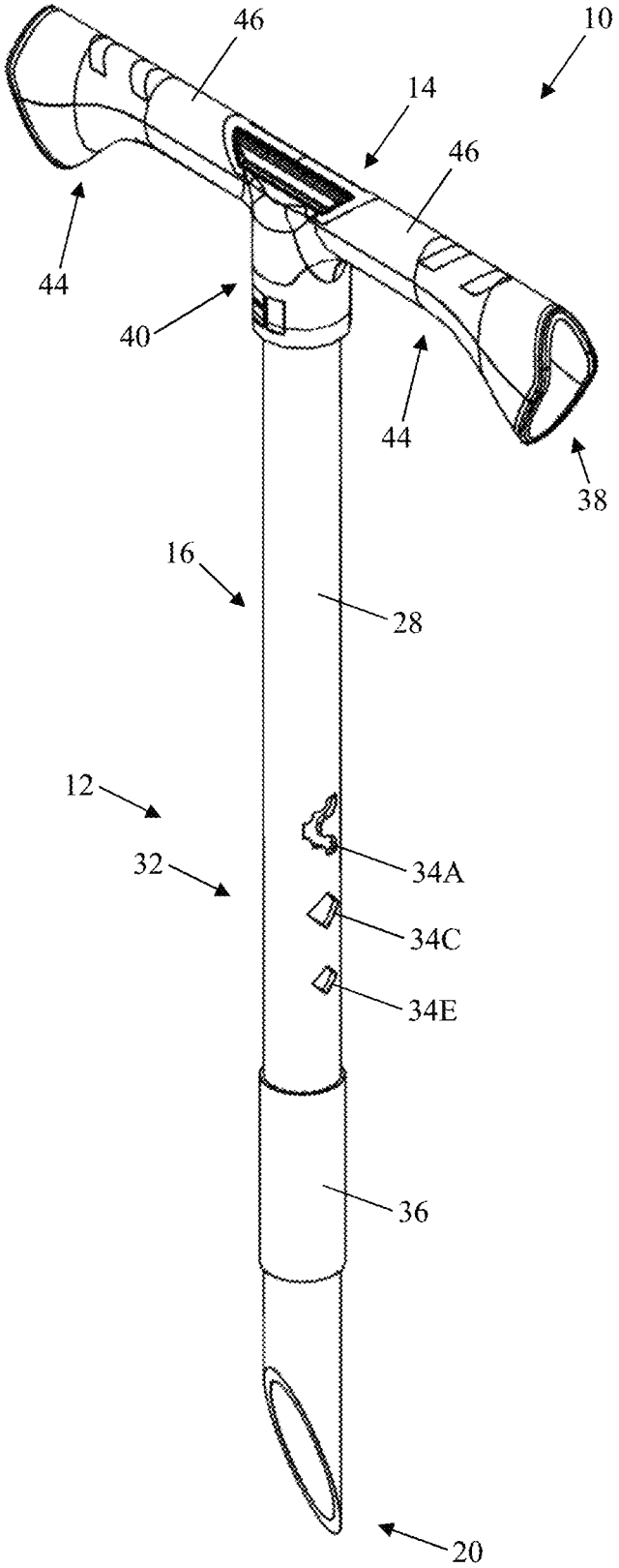
FIG. 1 is a front perspective of a post driver according to one embodiment of the present disclosure.
Figure 2:
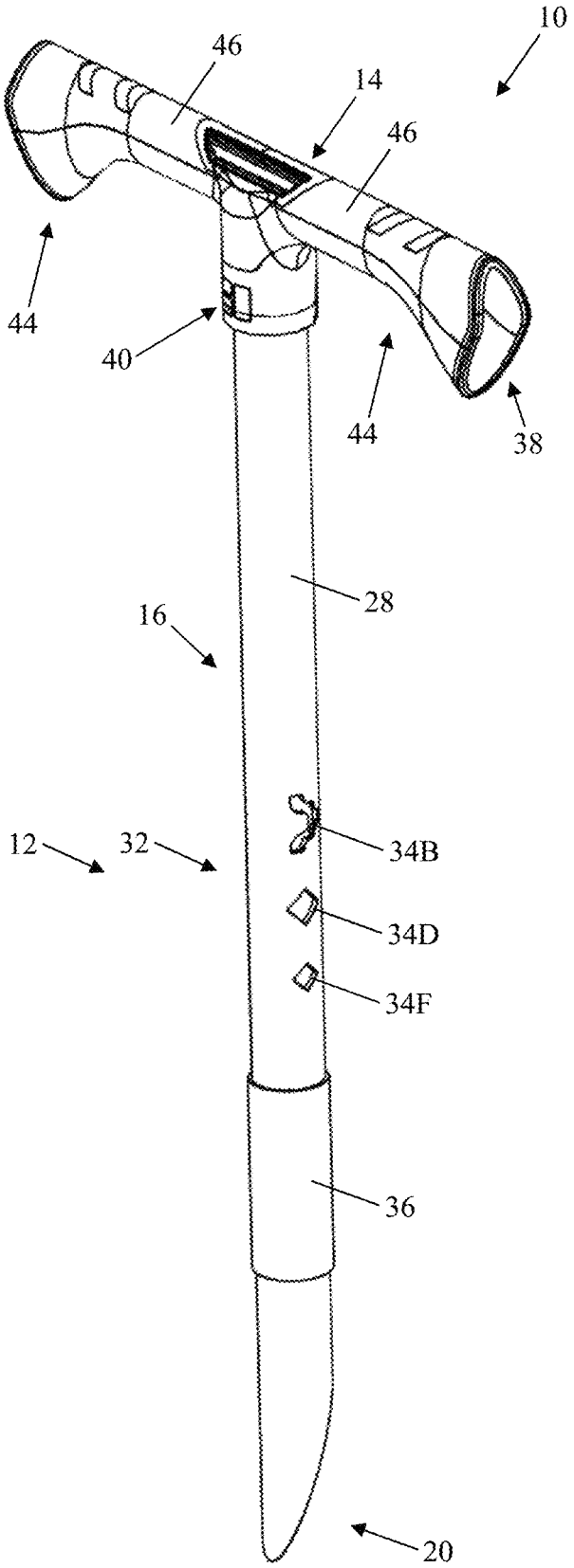
FIG. 2 is a rear perspective of the post driver.

Referring to FIGS. 1-7, one embodiment of a post driver (e.g., a post driver and remover) of the present disclosure is generally indicated by reference numeral 10. The post driver 10 is used to install a post P (FIG. 6), such as by driving the post into the ground. The post driver 10 is also a post remover and can be used to remove an installed post P, such as by removing the post from the ground G.

Figure 3:
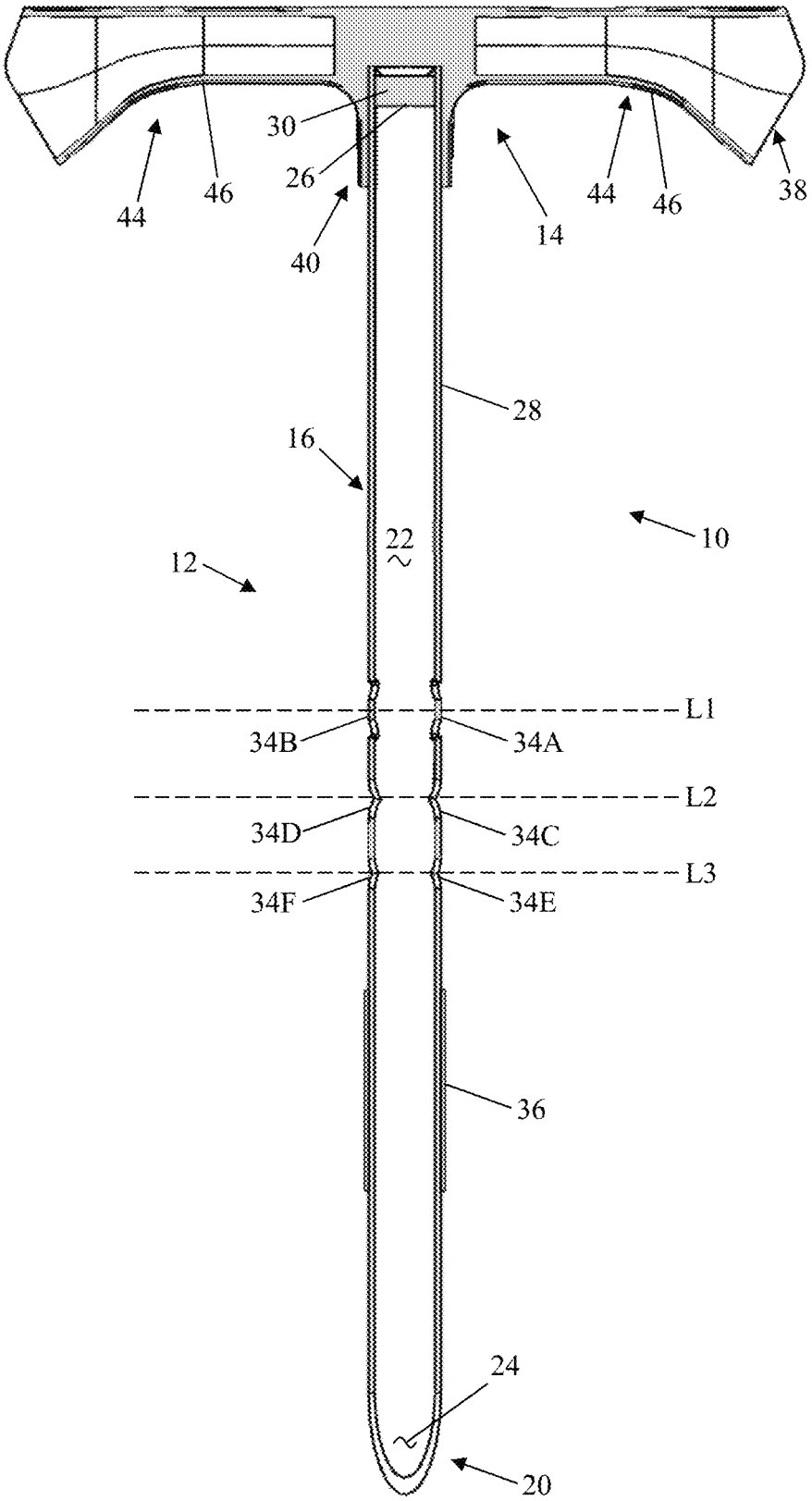
FIG. 3 is a cross-section of the post driver.
Figure 4:
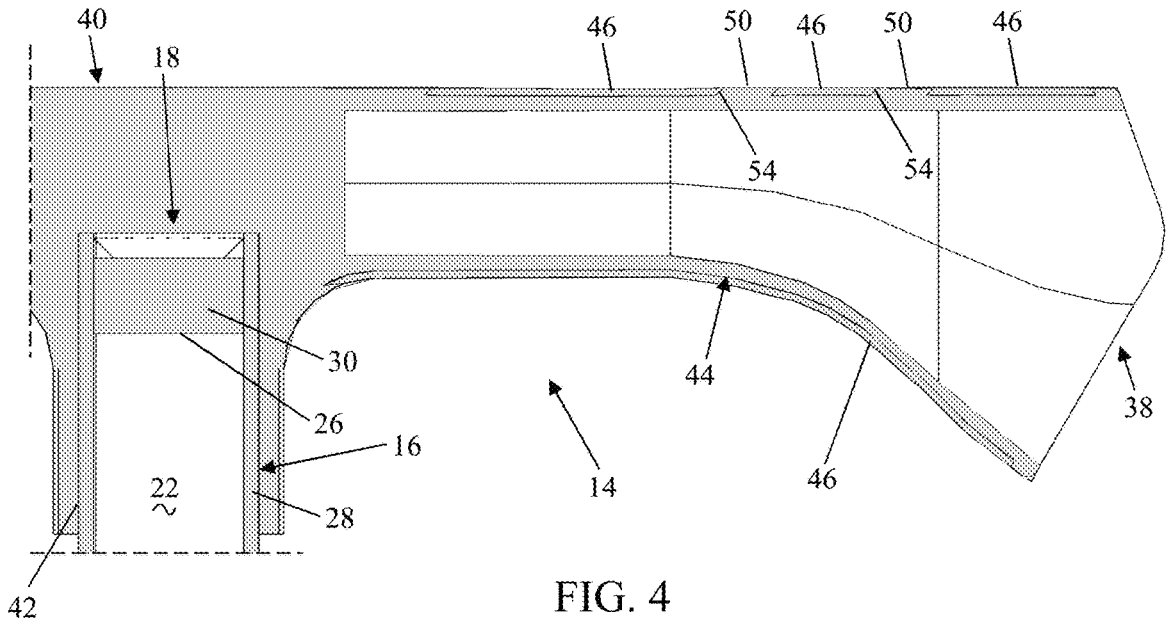
FIG. 4 is an enlarged, fragmentary cross-section of a handle of the post driver.
Figure 5:
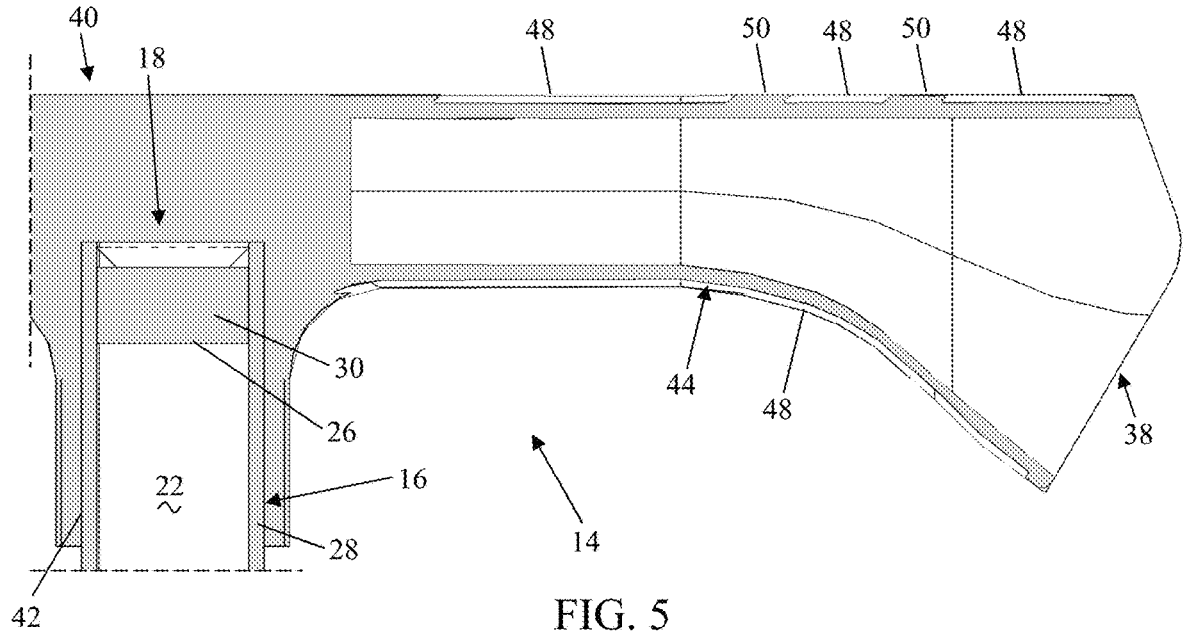
FIG. 5 is an enlarged, fragmentary cross-section of the handle with a grip of the handle hidden from view.

The post driver 10 includes a post receiver 12 and a handle 14. The post receiver 12 has a post receiver body 16. The post receiver body 16 is generally elongate, with a driving end 18 and an opposite driven end 20. The post receiver body 16 defines a post receiving space 22 having an open end 24 and an opposite closed end 26 (FIG. 3). The open end 24 is adjacent the driven end 20 and the closed end 26 is adjacent (e.g., at) the driving end 18. The post receiving space 22 is sized and shaped to receive an upper end portion of the post P. The post receiving space 22 is generally cylindrical. The post receiver body 16 includes a cylindrical wall or tube 28 and a plug or end cap 30 connected (e.g., securely fixed, such as by welding) to the cylindrical wall. The cylindrical wall 28 defines the post receiving space 22, with the end cap 30 defining the closed end 26 of the post receiving space. Desirably, the driven end 20 is beveled, although other configurations are within the scope of the present disclosure. The bevel of the driven end 20 makes it easier to insert the top end of the post P into the post receiving space 22. The bevel allows a user to engage the top end of the post with an inner surface of the post receiver 12 defining the post receiving space 22 to then slide the end of the post along the inner surface, through the open end 24 and into the post receiving space.

Figure 6:
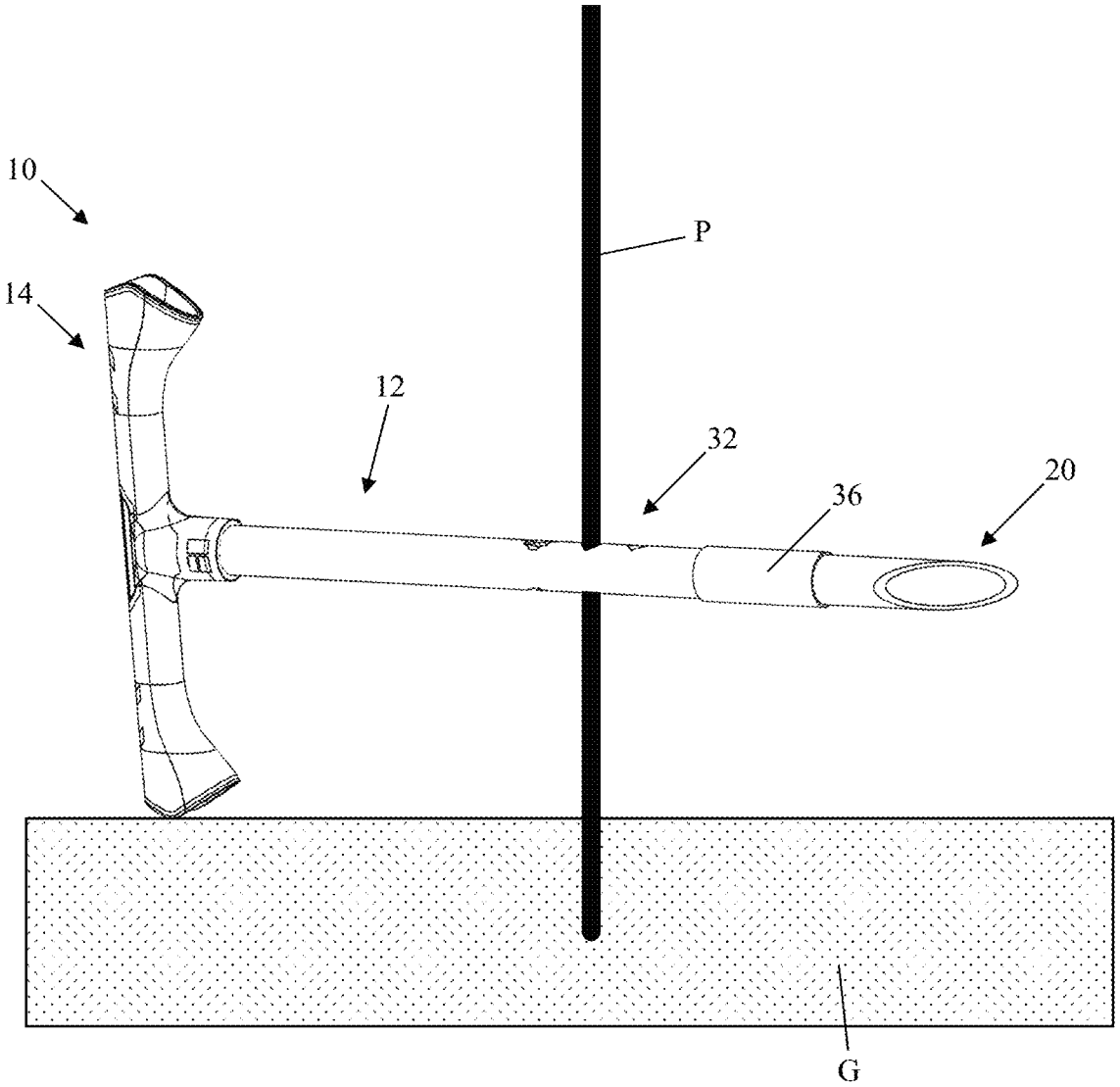
FIG. 6 is a perspective of the post driver removing a post from the ground.
Figure 7:
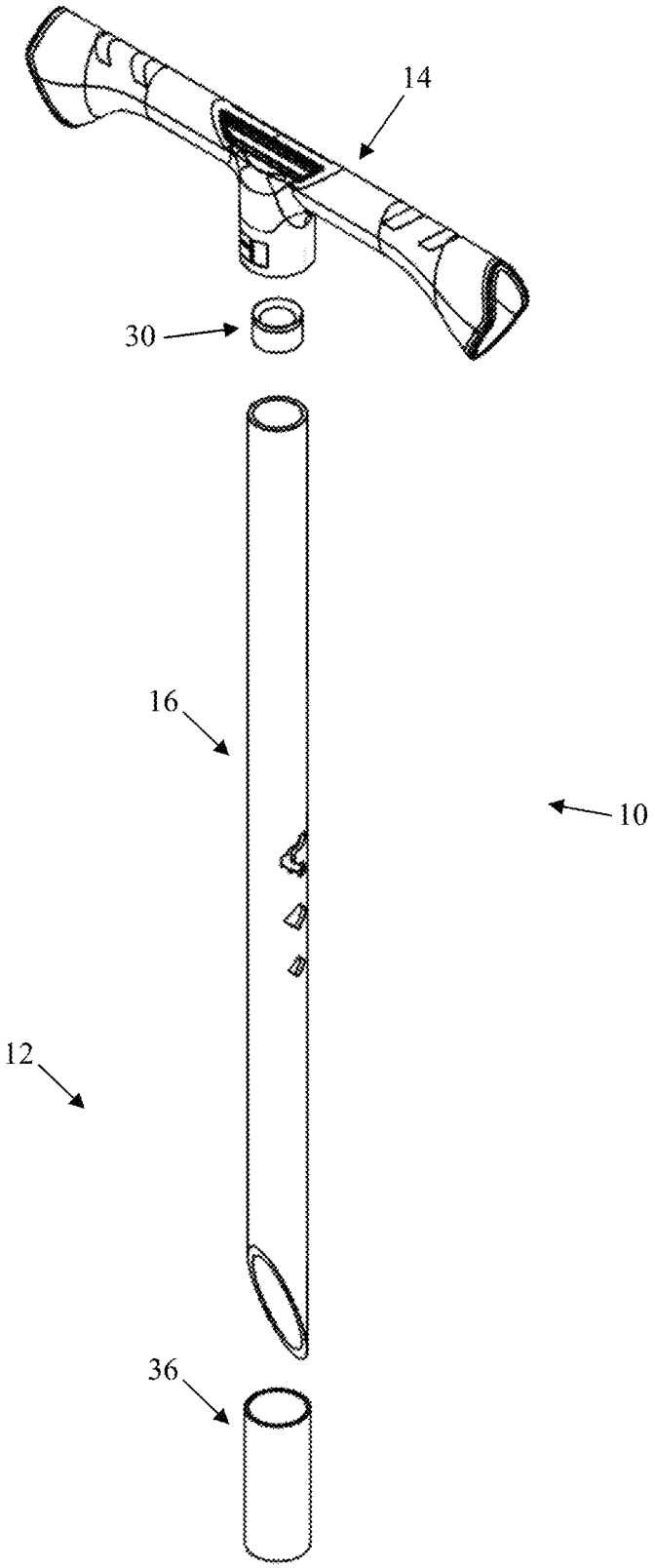
FIG. 7 is an exploded view of the post driver.

The post receiver 12 includes a post extractor 32 configured to remove posts P from the ground G. An installed post P is inserted into the post extractor 32 and the post driver 10 is then operated by the user to remove the post from the ground G (FIG. 6). In the illustrated embodiment, the post extractor 32 includes a plurality (broadly, two or more) extractors. The post extractor 32 comprises a plurality of extraction holes 34 (broadly, "openings") in the post receiver body 16. The extraction holes 34 are sized and shaped to receive a post P therein, such that the post extends therethrough. Each extraction hole 34 has a perimeter entirely bounded by the post receiver body 16. In other words, the post receiver body 16 defines the entirety of each extractor hole 34 (e.g., the extractor holes do not have an open end or side). In the illustrated embodiment, the post receiver body 16 (specifically, the cylindrical wall 28) includes (e.g. defines) a first pair or set of extraction holes (e.g., a first extraction hole 34A and a second extraction hole 34B), a second pair or set of extraction holes (e.g., a third extraction hole 34C and a fourth extraction hole 34D), and a third pair or set of extraction holes (e.g., a fifth extraction hole 34E and a sixth extraction hole 34F). The first and second extraction holes 34A, 34B form a first extractor, the third and fourth extraction holes 34C, 34D form a second extractor, and the fifth and sixth extraction holes form a third extractor.

Each pair of extraction holes 34 is configured to operate together to remove a post P of a particular size and/or shape from the ground G. Accordingly, the holes of each pair of extraction holes have a size and shape to permit a particular size and shape of a post P to be received therein. Each extraction hole 34 in a pair has an identical size and shape.

The extraction holes 34 in each pair have a size and/or shape that is different than the extraction holes of at least one of the other pairs. Desirably, the size and/or shape of the extraction holes 34 in each pair are different than the size and/or shape of the extraction holes of the other pairs. Broadly, the extraction holes 34 of each pair desirably have at least one of a different shape than the shapes of the other pairs of extraction holes or a different size than the other pairs of extraction holes. This allows the post extractor 32 to be used with posts of different cross-sectional shapes and/or sizes. In the illustrated embodiment, the first and second extraction holes 34A, 34B have a first shape, the third and fourth extraction holes 34C, 34D have a second shape different than the first shape, and the fifth and sixth extraction holes also have the second shape. The first shape corresponds to the cross-sectional shape (e.g., a first cross-sectional shape) of one type of post P (e.g., a first post) and the second shape is different from the first shape. In the illustrated embodiment, the first and second holes 34A, 34B are generally U-shaped to correspond to the U-shaped cross-section of a U-post. The third and fourth holes 34C, 34D are generally diamond-shaped. And the fifth and sixth holes 34F, 34E are generally diamond-shaped. The extraction holes having the diamond shape are intended for use with posts (e.g., fiberglass posts) having a round cross section, and the opposing edge segments of the diamond shaped holes (e.g., edge segments forming a generally V-shape) facilitate gripping opposing sides of the post. However, it will be understood the extraction holes having the diamond shape can be used for extracting posts of other cross-sectional shapes (e.g., diamond or square). Other shapes and sizes of the extractor openings are within the scope of the present disclosure. For example, the extractor openings could have a circular shape, a square shape, a rectangular shape, etc. In the illustrated embodiment, the second shape of the third and fourth extraction holes 34C, 34D is larger than the second shape of the fifth and sixth extraction holes 34E, 34F. This allows the third and fourth extraction holes 34C, 34D to be used to extract a larger post P having the same shape as the post the fifth and sixth extraction holes 34E, 34F extract. In the illustrated embodiment, the third and fourth extraction holes 34C, 34D are sized to receive a ½ inch diameter post and the fifth and sixth extraction holes 34E, 34F are sized to receive a ⅜ inch diameter post. It is understood that the extraction holes 34 can receive smaller posts. For example, the user can insert a ⅜ inch diamond post into the third and fourth extraction holes 34, 34D.

Referring to FIG. 3, the extractor holes 34 of each pair are aligned with one another to receive the post P therein. The extractor holes 34 of each pair are disposed directly across from each other on opposite sides of the post receiver body 16. For example, the first extractor hole 34A is on a first or right side of the post receiver body 16 and the second extractor hole 34B is on a second or left side of the post receiver body. The pairs of extractor openings 34 are adjacent to each other. Imaginary lines L1, L2, L3 extending through the center of the extractor openings 34 of each pair are generally parallel to each other. Aligning the extractor openings 34 in this manner allows the user to quickly select the pair of extraction holes 34 to use with a post P. For example, the user can simply move the post driver 10 in one direction to select the right size of extraction holes 34 for a post P. This is especially useful when at least some of the pairs of extractor openings 34 have the same shape, but different sizes, as it enables to user to quickly select the right size of extractor openings. The user inserts the post to be removed into a selected set of extractor holes 34, then torques the tool 10 on the post to slightly bend the post, and pulls the tool upward to extract the post, as explained in further detail below.

The post receiver 12 (e.g., the post receiver body 16 and the plug 30) can comprise a rigid material such as a metallic material (e.g., steel) or the like. The post receiver body 16 and the plug 30 may be a unitary, one-piece component or multiple pieces joined together, such as by welding.

Referring to FIGS. 1-3, 6 and 7, the post receiver 12 also includes a grip 36 (e.g., a post receiver grip). The grip 36 is connected to the post receiver body 16. The grip 36 is disposed between the driving and driven ends 18, 20. In particular, the grip 36 is disposed adjacent the driven end 20 of the post receiver body 16. In the illustrated embodiment, the grip 36 is disposed between the post extractor 32 (e.g., the extraction openings 34) and the driven end 20. The grip 36 is generally cylindrical and is mounted on the cylindrical wall 28. The grip 36 may be made of any suitable material such as plastic (e.g., polyvinyl chloride), fabric, silicone, rubber, or the like. For example, the grip could be molded onto the receiver 12 or installed over the receiver to form a friction fit.

Referring to FIGS. 1-5, the handle 14 is connected (e.g., attached) to the post receiver 12. The handle 14 includes a handle body 38. The handle body 38 is connected to the post receiver body 16. The handle body 38 includes a connection portion 40 (e.g., a post receiver body connection portion) that is connected to the driving end 18 of the post receiver body 16. The connection portion 40 defines a post receiver body space or recess 42 in which the post receiver body 16 is received. The handle 14 is arranged such that the handle and post receiver 12 form a T-shape (broadly, the handle body 38 is a T-shaped handle body). The handle body 38 includes first and second handle members 44. The first and second handle members 44 are connected to opposite sides (e.g., first and second sides) of the connection portion 40. The first and second handle members 44 are arranged on generally opposite sides of the post receiver 12, to form the T-shape. The first and second handle members 44 extend outward, from the connection portion 40, in generally opposite directions (e.g., first and second directions). The first and second directions are generally parallel to the imaginary lines L1, L2, L3 that extend through the extraction openings 34. Accordingly, the handle 14 is arranged to be generally parallel to the imaginary lines L1, L2, L3. As explained in more detail below, this arrangement allows the handle 14 to be used as a fulcrum when extracting a post P from the ground G. The first and second handle members 44 are generally identical to one another (e.g., are mirror images of one another).

In one embodiment, the handle may include a rigid member (not shown) to strengthen and stiffen the handle. The rigid member may extend longitudinally along the handle and be encased or surrounded by the handle body. The rigid member may be connected (such as by welding) to the driving end of the post receiver. The rigid member may comprise a rigid material such as a metallic material (e.g., steel) or the like. In one embodiment, the rigid member is a length of metal tubing (e.g., circular or square metal tubing).

The handle 14 includes at least one grip 46 mounted on the handle body 38. The at least one grip 46 is arranged to be engaged by the user when the user operates the post driver 10 to install the post P (e.g., when the user grabs the handle 14). Accordingly, the at least one grip 46 defines at least a portion of the exterior surface of the handle 14. In the illustrated embodiment, the handle 14 includes first and second grips 46. The first grip 46 is mounted on the first handle member 44. The first grip 46 is generally recessed into the first handle member 44. The first handle member 44 defines a first grip cavity or depression 48 in which the first grip 46 is disposed. Exterior surfaces of the first grip 46 and the first handle member 44 are generally flush with one another. This provides a smooth transition between the first handle member 44 and the first grip 46 to make it easy for a user to position their hand at generally any position along the first handle member. The illustrated first grip 46 is entirely disposed in the first grip cavity 48. The first grip 46 (e.g., an interior surface thereof) conforms to the size and shape of the first handle member 44 (e.g., a surface thereof defining the base of the cavity 48). The first grip 46 defines a lumen therethrough in which the first handle member 44 is disposed. To further enhance the attachment between the first grip 46 and the first handle member 44, the first grip and the first handle member can be mated together. Desirably, one of the first grip 46 and the first handle member 44 includes at least one projection 50 (e.g., a plurality of projections) and the other of the first grip and the first handle member includes at least one recess 52 (e.g., a plurality of recesses). Each projection 50 is disposed in one of the recesses 52 to inhibit the first grip 46 and the first handle member 44 from moving (e.g., sliding) relative to each other. In the illustrated embodiment, the first grip 46 includes (e.g., defines) the recesses 52 and the first handle member 44 includes the projections 50. Alternatively, the first grip could include the projections and the first handle member could include the recesses or the first grip and the first handle member could both include a combination of projections and recesses. The illustrated recesses 52 are openings extending through the first grip 46. The illustrated projections 50 comprise ribs extending radially outward into the openings 52. In the illustrated embodiment, the handle 14 includes two projections 50 and two recesses 52, although more or fewer are within the scope of the present disclosure. As illustrated, the exterior surfaces of the projections 50 are flush with the exterior surface of the first grip 46.

The second grip 46 is generally identical to the first grip (e.g., is a mirror image thereof). The second grip 46 is mounted on the second handle member 44. The second grip 46 is generally recessed into the second handle member 44. The second handle member 44 defines a second grip cavity or depression 48 in which the second grip 46 is disposed. Exterior surfaces of the second grip 46 and the second handle member 44 are generally flush with one another. This provides a smooth transition between the second handle member 44 and the second grip 46 to make it easy for a user to position their hand at generally any position along the second handle member. The illustrated second grip 46 is entirely disposed in the second grip cavity 48. The second grip 46 (e.g., an interior surface thereof) conforms to the size and shape of the second handle member 44 (e.g., a surface thereof defining the base of the cavity 48). The second grip 46 defines a lumen therethrough in which the second handle member 44 is disposed. To further enhance the attachment between the second grip 46 and the second handle member 44, the second grip and the second handle member can be mated together. Desirably, one of the second grip 46 and the second handle member 44 includes at least one projection 50 (e.g., a plurality of projections) and the other of the second grip and the second handle member includes at least one recess 52 (e.g., a plurality of recesses). Each projection 50 is disposed in one of the recesses 52 to inhibit the second grip 46 and the second handle member 44 from moving (e.g., sliding) relative to each other. In the illustrated embodiment, the second grip 46 includes (e.g., defines) the recesses 52 and the second handle member 44 includes the projections 50. Alternatively, the second grip could include the projections and the second handle member could include the recesses or the second grip and the second handle member could both include a combination of projections and recesses. The illustrated recesses 52 are openings extending through the second grip 46. The illustrated projections 50 comprise ribs extending radially outward into the openings 52. In the illustrated embodiment, the handle 14 includes two projections 50 and two recesses 52, although more or fewer are within the scope of the present disclosure. As illustrated, the exterior surfaces of the projections 50 are flush with the exterior surface of the second grip 46.

The handle body 38 is, desirably, a unitary, one-piece component (e.g., the connection portion 40 and the first and second handle members 44 are unitary, one-piece components). In other embodiments, the handle body 38 may be multiple pieces joined together, such as by welding or bonding. Desirably, the handle body 38 comprises a polymeric material such as a nylon, plastic or the like. Broadly, the post receiver 12 (e.g., the post receiver body 16 and the plug 30) comprise a first material (e.g., a metallic material) and the handle body 38 comprises a second material (e.g., a polymeric material) that is different from the first material. The first material is able to withstand the repeated impacts against the post P while the second material, desirably, dampens the force of each impact felt by the user. The first and second grips 46 may be made of any suitable material such as thermoplastic elastomer, plastic (e.g., polyvinyl chloride), fabric, silicone, rubber, etc. (broadly, a third material that may be different than the first and/or second materials). The handle body 38, in combination with the first and second grips 46, provides better grip, comfort, and impact dampening properties than conventional post drivers with metal handles. The handle 14 provides impact dampening to lessen the force of each impact against the post P felt by the user as the post driver 10 repeatedly strikes the post.

In one embodiment, the handle body 38 is formed by injection molding and then the first and second grips 44 are molded (e.g., overmolded) onto the handle body. For example, the handle body 38 may be injection molded onto the receiver 12 after fabricating the receiver. Other ways of forming the handle 14 are within the scope of the present disclosure. Securely attaching the first and second grips 46 to the handle body 38, as described herein (e.g., such as by using projections 50 and recesses 52), inhibits the first and second grips from moving relative to the handle body (e.g., the first and second handle members 44) as the post driver 10 is repeatedly used to strike the post into the ground.

In operation, to install a post P into the ground G, a bottom end or tip of the post is positioned where the user desires to drive the post into the ground. The upper end portion of the post P is positioned in the post receiving space 22 by inserting the upper end of the post through the open end 24 of the post receiving space. While the upper end portion of the post P is within the post receiver 12 (e.g. in the post receiving space 22), the user, grasping the handle 14, moves the post driver 10 upward and downward repeatedly along the post to repeatedly strike the upper end of the post with the closed end 26 of the post receiving space 22 (broadly, the post receiver 12) to drive the post into the ground G. As the post driver 10 is moved up and down, the user keeps the upper end portion of the post P within the post receiving space 22 to guide and balance the post as the post is driven into the ground.

The post receiving space 22 can be sized and shaped to receive generally any size and shape of post P. In the illustrated embodiment, the post receiving space 22 is sized and shaped to receive a relatively thin (e.g., about 1 inch diameter) post or a relatively thin U-shaped cross-section post. Such posts may be used as part of a fence (e.g., an electric fence). In one embodiment, the post receiving space 22 may have a diameter of about 30 mm (about 1.2 inches, broadly less than about 1.5 inches, or less than 2 inches). Having the post receiving space 22 (e.g., a width or diameter thereof) sized to generally correspond to the size of the post P being driven into the ground G minimizes the chances the post driver 10 damages the post as the post is driven into the ground. For example, standard post drivers typically have a post receiving space with a large internal diameter (e.g., about 3.5 inches). Although these standard post drivers can be used to drive smaller posts P into the ground G, the standard post drivers tend to drive these smaller posts into the ground at an angle and/or snap the post into pieces due to the excess room inside the post receiving space of the post driver. Other tools, such as a hammer, can also be used to drive smaller posts P into the ground G, but this frequently results in the tool shattering the end of the post, exposing the fiberglass fibers and potentially injuring a user's hands. Accordingly, the illustrated post driver 10 is better suited to drive smaller posts 10 into the ground than other conventional methods.

Referring to FIG. 6, to remove a post P from the ground G, the user selects the pair of extractor openings 34 corresponding to the post (e.g., size and type of post) to be removed. For example, if the post P has a U-shape, the user selects the first and second extractor openings 34A, 34B. The user locates or aligns the desired pair of extractor openings 34 with the top of the post P. The user then moves the post driver 10 downward, sliding the end of the post P into and through the selected extractor openings 34. The user then operates or manipulates the post driver 10 to pull the post P from the ground G. As the user manipulates the post driver 10, the edges of the extraction openings 34 the post P is received in press against the post to grip the post and pull the post from the ground G. The post driver 10 creates a mechanical advantage the user employs to remove the post P from the ground G. For example, in one embodiment, the user can use the post driver 10 as a lever, with the handle 14 as a fulcrum, by pulling up on the grip 36 to pivot the post driver about the post P and engage an end of the handle 14 against the ground G. The extraction holes 34 are disposed in generally the middle of the post receiver 12 to enable the user to move the handle toward the ground G. Engaging the end of the handle 14 against the ground G establishes a pivot point (e.g., makes the handle 14 a fulcrum), about which the user can manipulate or pivot the post driver 10 to pull the post P from the ground. In another method, instead of engaging the post driver 10 with the ground G, the user may position the post driver along the post P at a comfortable position, such as about chest height, and then manipulate (e.g., twist, pivot, pull, wiggle, etc.) the post driver to remove the post from the ground. In this embodiment, the user may grip the handle 14 and the grip 36 of the post receiver 12 to manipulate the post driver 10. For example, the user may turn the receiver 12 clockwise or counterclockwise to apply torque to the post to bend the post and cause the openings 34 to increase frictional grip on the post, then move the receiver 12 upward to extract the post from the ground. The user may also repeatedly reposition the post driver 10 along the post P as desired (by sliding the post driver downward along the post) to maintain the pivot point against the ground G or to keep the post driver at a comfortable position as the post is incrementally raised upward, out of the ground.

When introducing elements of the present disclosure or the preferred embodiments(s) thereof, the articles "a", "an", "the" and "said" are intended to mean that there are one or more of the elements. The terms "comprising", "including" and "having" are intended to be inclusive and mean that there may be additional elements other than the listed elements.

It will be apparent that modifications and variations are possible without departing from the scope defined in the appended claims.

As various changes could be made in the above constructions and methods without departing from the scope of the disclosure, it is intended that all matter contained in the above description and shown in the accompanying drawings shall be interpreted as illustrative and not in a limiting sense.

What is claimed is:

1. A post driver and remover for the installation and removal of posts, the post driver comprising:

a post receiver having a post receiver body having a driving end and an opposite driven end, the post receiver body defining a post receiving space having an open end adjacent the driven end and a driver end adjacent the driving end, the post receiving space sized and shaped to receive an upper end portion of one of the posts, the post receiver body having a first extractor and a second extractor, the first extractor being configured to receive a first post of a first cross-sectional size or shape, and the second extractor being configured to have a different size or shape from the first extractor to receive a second post of a second cross-sectional size or shape, the first extractor being disposed between the open end and the driver end of the post receiving space.

2. The post driver of claim 1, wherein the first extractor includes first and second extractor openings in registration with one another to receive the first post in the first and second extractor openings at the same time, and wherein the second extractor comprises third and fourth extraction openings in registration with one another to receive the second post in the third and fourth extractor openings at the same time.

3. The post driver of claim 2, wherein the first and second extractor openings are disposed directly across from each other on opposite sides of the post receiver body, and the third and fourth extractor openings are disposed directly across from each other on opposite sides of the post receiver body.

4. The post driver of claim 3, wherein a first imaginary line extending through a center of the first and second extractor openings is generally parallel to a second imaginary line extending through a center of the third and fourth extractor openings.

5. The post driver of claim 4, wherein the handle includes first and second handle members extending outward in opposing first and second directions, the first and second directions being generally parallel to the first and second imaginary lines.

6. The post driver of claim 2, wherein the first, second, third and fourth extractor openings have closed peripheral edges extending fully around the respective openings.

7. The post driver of claim 1, wherein the post receiver includes a post receiver grip connected to the post receiver body, the post receiver grip disposed between the first extraction opening and the driven end.

8. The post driver of claim 1, wherein the post receiver body includes a third extractor configured to have a different size or shape from the first extractor and second extractor to receive a third post of a third cross-sectional size or shape.

9. The post driver of claim 8, wherein the third extractor comprises fifth and sixth extractor openings disposed on opposing sides of the post receiver body.

10. The post driver of claim 1, wherein the first extractor is configured to receive a U-shape cross-section of the first post and the second extractor is configured to receive a circular shaped cross-section of the second post.

11. A post driver for installing a post, the post driver comprising:

a post receiver having a post receiver body having a driving end and an opposite driven end, the post receiver body defining a post receiving space having an open end adjacent the driven end and a driver end adjacent the driving end, the post receiving space sized and shaped to receive an upper end portion of the post; and a handle including a handle body connected to the post receiver body and a grip mounted on the handle body, the grip disposed in a grip cavity of the handle body, the grip arranged to be engaged by the user when the user operates the post driver to install the post.

12. The post driver of claim 11, wherein the handle body includes a connection portion connected to the driving end of the post receiver body, a first handle member extending outward in a first direction from a first side of the connection portion and a second handle member extending outward in a second direction from a second side of the connection portion, the second direction opposing the first direction.

13. The post driver of claim 12, wherein the grip is a first grip and the grip cavity is a first grip cavity, the handle including a second grip, the first grip being disposed in the first grip cavity, the first grip cavity defined by the first handle member, the second grip being disposed in a second grip cavity defined by the second handle member.

14. The post driver of claim 13, wherein one of the first grip or the first handle member includes at least one projection and the other of the first grip or the first handle member includes at least one recess, each projection disposed in one of the at least one recess to inhibit the first grip and the first handle member from moving relative to one another.

15. The post driver of claim 14, wherein the first grip includes the at least one recess and the first handle member includes the at least one projection.

16. The post driver of claim 14, wherein one of the second grip or the second handle member includes at least one projection and the other of the second grip or the second handle member includes at least one recess, each projection of said second grip or second handle member disposed in one of the at least one recess of said other of the second grip and the second handle member to inhibit the second grip and the second handle member from moving relative to one another.

17. The post driver of claim 16, wherein the second grip includes the at least one recess and the second handle member includes the at least one projection.

18. The post driver of claim 11, wherein the post receiver body includes a generally cylindrical tube and a plug connected to the tube, the plug defining the driver end of the post receiving space.

19. The post driver of claim 11, wherein the post receiver includes a post receiver grip connected to the post receiver body, the post receiver grip disposed between the driving and driven ends of the post receiver body.

20. The post driver of claim 11, wherein the driven end of the post receiver body is beveled.

21. The post driver of claim 11, wherein the grip is a molded grip molded on the handle body.

22. The post driver of claim 11, wherein the handle body includes an exterior surface and the grip includes an exterior surface, the exterior surfaces of the handle body and the grip being flush with one another and being arranged to be grasped by a hand of a user.

23. The post driver of claim 13, wherein the first and second grips each comprise a molded grip molded on the handle body.

24. The post driver of claim 13, wherein the first handle member includes an exterior surface and the first grip includes an exterior surface, the exterior surfaces of the first handle member and the first grip being flush with one another and being arranged to be grasped by a hand of a user, and wherein the second handle member includes an exterior surface and the second grip includes an exterior surface, the exterior surfaces of the second handle member and the second grip being flush with one another and being arranged to be grasped by a hand of a user.

25. The post driver of claim 11, wherein the grip is molded on and engaged with the handle body to conform to the handle body.

26. The post driver of claim 2, wherein the first and second extractor openings are in fluid communication with the post receiving space.

27. The post driver of claim 26, wherein the third and fourth extraction openings are in fluid communication with the post receiving space.

28. The post driver of claim 1, wherein the first extractor comprises a first opening in fluid communication with the post receiving space.

29. The post driver of claim 28, wherein the first extractor comprises a second opening in fluid communication with the post receiving space.

30. The post driver of claim 29, wherein the first extractor defines a first post receiving axis extending through the first and second openings and across the post receiving space.

31. The post driver of claim 30, wherein the post receiver body has a longitudinal axis extending between the driving and driven ends, the first post receiving axis being transverse to the longitudinal axis.

32. The post driver of claim 30, wherein the second extractor comprises third and fourth openings in fluid communication with the post receiving space, the first extractor defining a second post receiving axis extending through the second and third openings and across the post receiving space.

33. The post driver of claim 1, wherein the second extractor is disposed between the open end and the driver end of the post receiving space.

34. The post driver of claim 12, wherein the grip is a first grip, the handle including a second grip, the first grip being molded on and engaged with the first handle member to conform to the first handle member, the second grip being molded on and engaged with the second handle member to conform to the second handle member, the first grip arranged to be grasped by one hand of the user and the second grip arranged to be grasped by another hand of the user.

35. The post driver of claim 34, wherein the post receiver body is disposed in a post receiver body space of the handle.

36. A post driver and remover for installation and removal of posts, the post driver comprising:

a post receiver having a post receiver body having a driving end and an opposite driven end, the post receiver body defining a post receiving space having an open end adjacent the driven end and a driver end adjacent the driving end, the post receiving space sized and shaped to receive an upper end portion of one of the posts, the post receiver body having a first extractor and a second extractor, the first extractor being configured to receive a first post of a first cross-sectional size or shape, and the second extractor being configured to have a different size or shape from the first extractor to receive a second post of a second cross-sectional size or shape, the first extractor including a first opening in fluid communication with the post receiving space.

37. The post driver of claim 36, wherein the first extractor includes a second opening in fluid communication with the post receiving space.

38. The post driver of claim 37, wherein the first extractor defines a first post receiving axis extending through the first and second openings and across the post receiving space.

39. The post driver of claim 38, wherein the post receiver body has a longitudinal axis extending between the driving and driven ends, the first post receiving axis being perpendicular to the longitudinal axis.

40. The post driver of claim 38, wherein the second extractor comprises third and fourth openings in fluid communication with the post receiving space, the first extractor defining a second post receiving axis extending through the second and third openings and across the post receiving space.

41. The post driver of claim 37, wherein the first and second openings are disposed on opposite sides of the post receiving space.

42. A post driver and remover for the installation and removal of posts, the post driver comprising:

a post receiver having a post receiver body having a driving end and an opposite driven end, the post receiver body defining a post receiving space having an open end adjacent the driven end and a driver end adjacent the driving end, the post receiving space sized and shaped to receive an upper end portion of one of the posts, the post receiver body having a first extractor and a second extractor, the first extractor being configured to receive a first post of a first cross-sectional size or shape, and the second extractor being configured to have a different size or shape from the first extractor to receive a second post of a second cross-sectional size or shape, the first extractor including a first opening configured to receive the first post, the first opening having a first closed peripheral edge extending fully around the first opening and fully enclosing a perimeter of the first opening, the second extractor including the second opening configured to receive the second post, the second opening having a second closed peripheral edge extending fully around the second opening and fully enclosing a perimeter of the second opening.

43. The post driver of claim 42, wherein the first extractor includes a third opening in registration with the first opening so that the first post is received in the first and third openings at the same time, the third opening having a third closed peripheral edge extending fully around the third opening and fully enclosing a perimeter of the third opening.

44. The post driver of claim 43, wherein the first and third openings are disposed directly across from each other on opposite sides of the post receiving space.

45. The post driver of claim 43, wherein the first and third openings are in fluid communication with the post receiving space.

46. The post driver of claim 43, wherein the first and third openings are spaced apart from one another.

47. The post driver of claim 42, wherein the second extractor includes a third opening in registration with the second opening so that the second post is received in the second and third openings at the same time, the third opening having a third closed peripheral edge extending fully around the third opening and fully enclosing a perimeter of the third opening.

48. The post driver of claim 43, wherein the second extractor includes a fourth opening configured to receive the second post, the second and fourth openings being in registration with one another to receive the second post in the second and fourth openings at the same time, the fourth opening having a fourth closed peripheral edge extending fully around the fourth opening and fully enclosing a perimeter of the fourth opening.

49. The post driver of claim 48, wherein the first and third openings are disposed directly across from each other on opposite sides of the post receiving space, and wherein the second and fourth openings are disposed directly across from each other on opposite sides of the post receiving space.

50. The post driver of claim 48, wherein the first, second, third, and fourth openings are each in fluid communication with the post receiving space.

51. The post driver of claim 48, wherein the first, second, third, and fourth openings are spaced apart from one another.

* * * * *